US008490711B2

(12) United States Patent
Polumati

(10) Patent No.: US 8,490,711 B2
(45) Date of Patent: Jul. 23, 2013

(54) RIPPER ASSEMBLY HAVING A LINKAGE ASSEMBLY AND AN ACTUATOR

(75) Inventor: Satish Kumar Polumati, Chennai (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/333,401

(22) Filed: Dec. 21, 2011

(65) Prior Publication Data

US 2013/0161036 A1 Jun. 27, 2013

(51) Int. Cl.
*A01B 63/00* (2006.01)

(52) U.S. Cl.
USPC ..... 172/484; 172/663

(58) Field of Classification Search
USPC ..... 172/484, 464, 663, 699, 260.5; 37/303, 37/455, 195
See application file for complete search history.

(56) References Cited

U.S. PATENT DOCUMENTS

| | | | | |
|---|---|---|---|---|
| 2,455,727 | A | 12/1948 | Bunting | |
| 3,038,267 | A | 6/1962 | Helton et al. | |
| 3,116,797 | A * | 1/1964 | Launder et al. | 172/484 |
| 3,539,018 | A * | 11/1970 | Sprenkel | 172/484 |
| 3,973,632 | A * | 8/1976 | Torazzi | 172/464 |
| 4,013,129 | A * | 3/1977 | Wilkinson | 172/464 |
| 4,321,970 | A * | 3/1982 | Thigpen | 172/464 |
| 4,351,397 | A * | 9/1982 | Winker | 172/464 |
| 4,817,731 | A * | 4/1989 | Karlak | 172/464 |
| 4,834,461 | A * | 5/1989 | Fidler et al. | 299/37.5 |
| 4,991,659 | A * | 2/1991 | Stepe et al. | 172/464 |
| 5,094,017 | A * | 3/1992 | Matsumoto et al. | 37/303 |
| 5,626,196 | A * | 5/1997 | Hughes | 172/558 |
| 7,445,053 | B2 * | 11/2008 | Matsumoto et al. | 172/699 |
| 2009/0199441 | A1 | 8/2009 | Jorgensen et al. | |

FOREIGN PATENT DOCUMENTS

GB 2061682 A 5/1981

* cited by examiner

*Primary Examiner* — Árpád Fábián-Kovács
(74) *Attorney, Agent, or Firm* — Leydig, Voit & Mayer

(57) ABSTRACT

A ripper assembly includes a linkage assembly and an actuator. The linkage assembly has a mounting section, a frame member with a frame axis, a carriage member and a connecting member. The actuator is movable along an actuator axis between a retracted position and an extended position. The linkage assembly is movable between a ground engaging position at which the actuator is at the retracted position and a raised position at which the actuator is at the extended position. An angle between the frame axis and the actuator axis is between approximately 40 degrees and 65 degrees when the linkage assembly is in the ground engaging position.

21 Claims, 5 Drawing Sheets

RIPPER ASSEMBLY HAVING A LINKAGE ASSEMBLY AND AN ACTUATOR

TECHNICAL FIELD

This disclosure relates generally to a ripper assembly and, more particularly, to a ripper assembly that increases the efficiency of forces transferred from an actuator to a ground engaging shank.

BACKGROUND

Ripper assemblies are often used to loosen hardened ground, break up rock formations and otherwise engage a ground surface. Ripper assemblies often include a parallelogram type linkage that is moveable between a first, raised position at which the ripper is positioned above the ground for transport and a second, ground-engaging position at which ground engaging shanks of the ripper assembly engage the ground surface. An actuator such as a hydraulic cylinder is often used to move the ripper assembly between the first and second positions.

Once the ripper assembly is in the ground engaging position, the actuator may also be used to apply a force to maintain the ground engaging shanks of the ripper assembly in the ground. To increase the force on the ground engaging shanks, a larger heavier, actuator may be used. However, in addition to increasing the size of the actuator, the larger actuator may also require an increase in the size of other components of the ripper assembly. A larger actuator and larger components of the ripper assembly may result in a heavier ripper assembly.

U.S. Patent Publication No. US 2009/0199441 A1 is directed to a ripper assembly that is moveable between a first, transportation position and second a second, ground engaging position. The configuration of the linkage assembly of the ripper assembly allows for improved operator visibility when in the first, raised position.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a ripper assembly is disclosed including a linkage assembly and an actuator. The linkage assembly has a mounting section, a frame member, a carriage member, and a connecting member. The frame member has a frame axis and is pivotally connected to the mounting section. The carriage member has at least one ground engaging shank and is pivotally connected to the frame member. The connecting member is pivotally connected to the mounting section and is pivotally connected to the carriage member. The actuator is movable along an actuator axis between a retracted position and an extended position. The actuator is pivotally connected to the frame member and is pivotally connected to the carriage member. The linkage assembly is movable between a ground engaging position at which the actuator is at the retracted position and a raised position at which the actuator is at the extended position. An angle between the frame axis and the actuator axis is between approximately 40 degrees and 65 degrees when the linkage assembly is in the ground engaging position.

In another aspect, a machine is disclosed including a frame, a prime mover, a ground engaging propulsion device, and a ripper assembly. The ripper assembly includes a linkage assembly and an actuator. The linkage assembly has a mounting section, a frame member, a carriage member and a connecting member. The frame member has a frame axis and is pivotally connected to the mounting section. The carriage member has at least one ground engaging shank and is pivotally connected to the frame member. The connecting member is pivotally connected to the mounting section and is pivotally connected to the carriage member. The actuator is movable along an actuator axis between a retracted position and an extended position. The actuator is pivotally connected to the frame member and is pivotally connected to the carriage member. The linkage assembly is movable between a ground engaging position at which the actuator is at the retracted position and a raised position at which the actuator is at the extended position. An angle between the frame axis and the actuator axis is between approximately 40 degrees and 65 degrees when the linkage assembly is in the ground engaging position.

DETAILED DESCRIPTION

Figure 1:
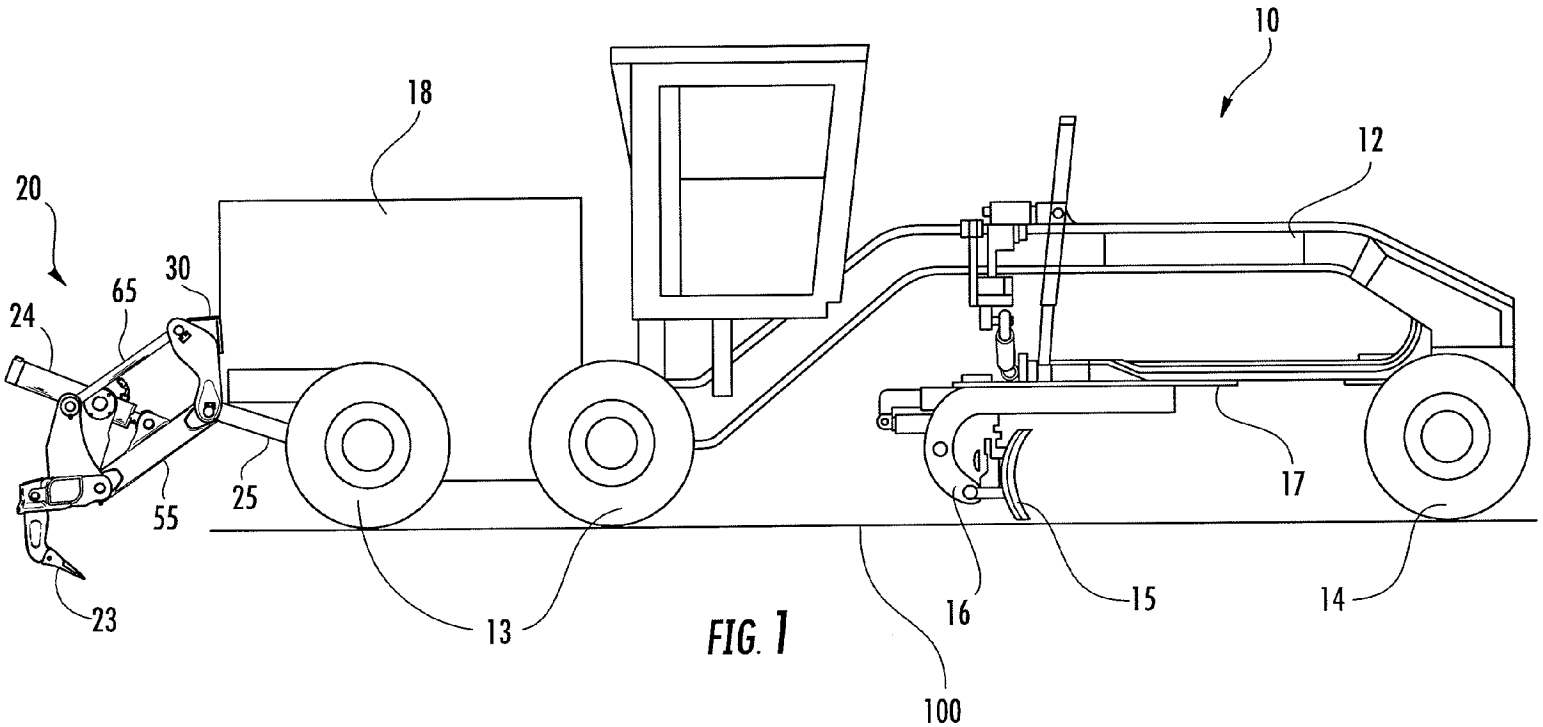
FIG. 1 shows a diagrammatic illustration of a machine having a ripper assembly in accordance with the disclosure.

Referring to FIG. 1, a machine 10 such as a motor grader is depicted. The machine 10 has a frame 12 and a ground engaging propulsion system including two sets of rear wheels 13 and a set of front wheels 14. A blade or moldboard 15 is mounted on a blade tilt adjustment mechanism 16 that is supported by a rotatable circle assembly 17 positioned beneath frame 12. A variety of hydraulic cylinders may be provided for controlling the position of the moldboard 15. A prime mover such as engine 18 provides the power necessary to propel the machine 10 as well as operate the various actuators and systems of the machine. In a hydrostatically operated machine, the engine 18 powers a hydrostatic pump (not shown) which in turn drives a hydrostatic motor (not shown) to propel the machine 10. The hydrostatic pump may also drive other hydraulic systems of the machine. A ripper assembly 20 may be mounted at a rear section of the frame 12 of the machine 10. Although ripper assembly 20 is mounted on a motor grader, the ripper assembly may be mounted on other types of machines such as a dozer, a tractor and the like.

Figure 2:
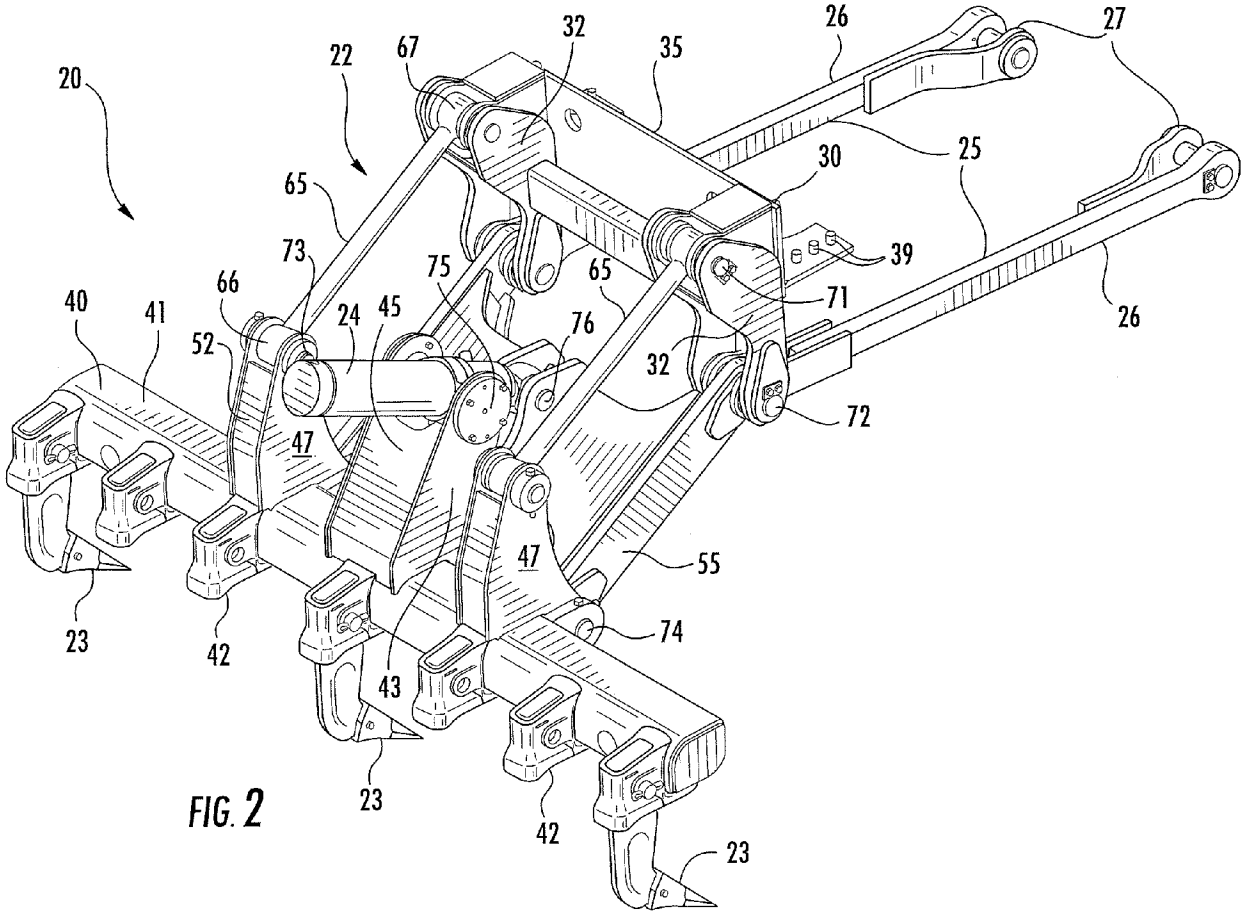
FIG. 2 is perspective view of a ripper assembly according to the present disclosure.
Figure 3:
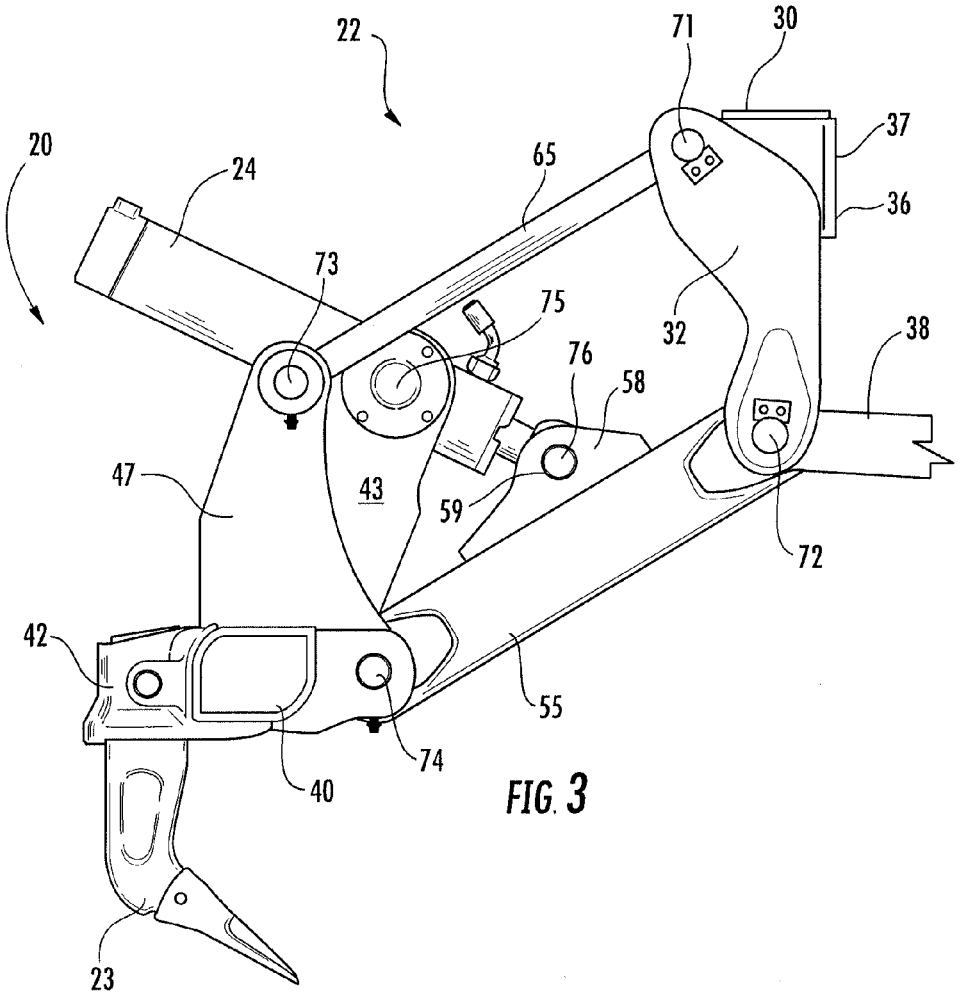
FIG. 3 is side view of the ripper assembly of FIG. 2.
Figure 4:
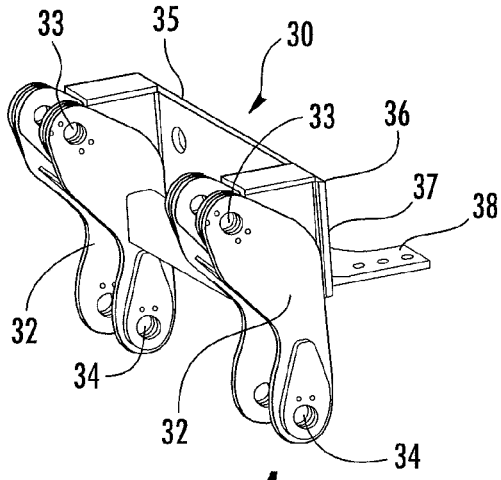
FIG. 4 is a perspective view of the mounting section of the ripper assembly of FIG. 2.
Figure 5:
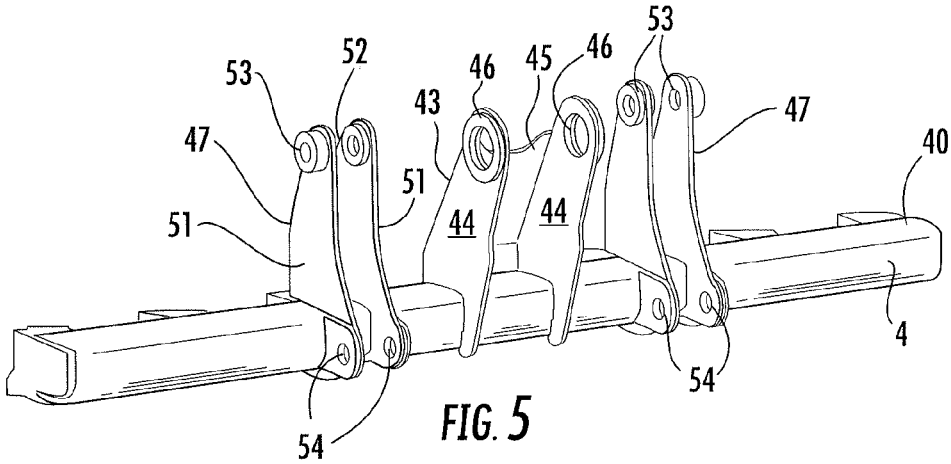
FIG. 5 is a perspective view of the carriage member of the ripper assembly of FIG. 2.

As depicted in more detail in FIGS. 2-3, the ripper assembly 20 has a linkage assembly 22 that includes one or more ground engaging shanks 23 for engaging and digging into a ground reference such as ground 100 (FIG. 1). A hydraulic cylinder or actuator 24 may be provided to control the position of the linkage assembly 22. Ripper assembly 20 may also include a pair of elongated tag links 25 that extend forwardly from the linkage assembly 22 to assist in securing the ripper assembly to the machine 10. Each tag link 25 has an elongated arm 26 with a rear tag link bore (not shown) and a forward tag link bore 27.

Linkage assembly 22 may include a mounting section 30, a carriage member 40, a frame member 55 and a pair of spaced apart, connecting members 65. Mounting section 30 may be configured to secure the ripper assembly 20 to the frame 12 of machine 10. Mounting section 30 may have a pair of spaced apart, rearwardly facing (to the left in FIG. 3) support arms 32. Each support arm 32 may have an upper mounting bore 33 and a lower mounting bore 34. The support arms 32 may be laterally connected by a cross member 35. In an alternate configuration, the upper mounting bore 33 and lower mounting bore 34 of mounting section 30 may be individually secured to the frame 12 of the machine 10 so that the connection between the upper mounting bore and lower mounting is through the frame 12 rather than through support arms 32. Mounting section 30 may also include a forwardly facing bracket 36 having a vertical surface 37 and a horizontal surface 38. Each of the vertical surface 37 and horizontal surface 38 may engage a portion of the machine 10 to mount the ripper assembly 20 to the frame 12 by fasteners such as bolts 39.

Carriage member 40 may have a generally elongated, tubular cross member 41 on which a plurality of ground engaging shanks 23 may be mounted. Cross member 41 may be configured with a plurality of mounting brackets 42 to permit the ground engaging shanks 23 to be removably mounted thereon. In FIG. 2, cross member 41 is depicted as having seven mounting brackets 42 and three ground engaging shanks 23 mounted within the brackets. The carriage member 40 may have other numbers of brackets and shanks if desired.

Cross member 41 may have an actuator tower 43 extending upward generally from a central portion thereof in a direction generally opposite the ground engaging shanks 23. Actuator tower 43 may be formed with a pair of spaced apart vertical central plates 44 that are connected by a rear cover plate 45 to increase the rigidity of the actuator tower 43. The actuator tower 43 may have an upper actuator tower bore 46 for connecting to actuator 24. A pair of connecting towers 47 may be positioned on cross member 41 so that the connecting towers 47 are positioned on opposite sides of the actuator tower 43. Each connecting tower 47 may be formed with a pair of vertical carriage plates 51 connected by a rear carriage cover 52 to increase the rigidity of the connecting towers 47. The connecting towers 47 may have an upper carriage bore 53 and a lower carriage bore 54 spaced from the upper carriage bore.

Figure 6:
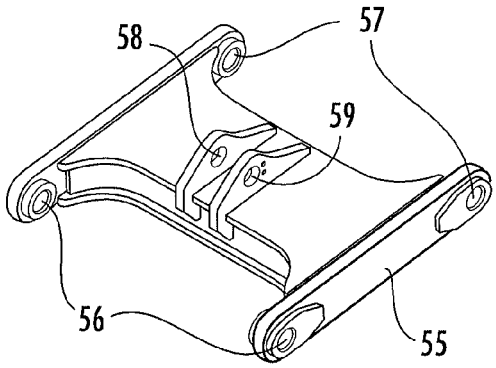
FIG. 6 is a perspective view of the frame member of the ripper assembly of FIG. 2.

Base or frame member 55 may be generally planar and extend between the mounting section 30 and the carriage member 40. As best seen in FIG. 6, the frame member 55 has a pair of spaced apart, rear frame bores 56 and a pair of spaced apart, forward frame bores 57. Frame member 55 may also include an upwardly extending frame bracket 58 with a lower actuator bracket bore 59 therein. Frame member 55 may be cast or fabricated as a one-piece member, formed as an assemblage of multiple components or may be a plurality of distinct, spaced apart components that support actuator 24 and connect mounting section 30 to carriage member 40.

Connecting members 65 may be generally cylindrical rods that extend between the mounting section 30 and the carriage member 40. Each connecting member 65 may have a rear connecting bore 66 and a forward connecting bore 67.

Ripper assembly 20 has a plurality of pins pivotally connecting the various components. More specifically, ripper assembly 20 may include a pair of forward upper pins 71 with each forward upper pin extending through an upper mounting bore 33 of mounting section 30 and a forward connecting bore 67 of one of the connecting members 65 to pivotally connect each of the connecting members 65 to the mounting section 30. A forward lower pin 72 may extend through each lower mounting bore 34 of mounting section 30, a forward frame bore 57 of frame member 55, and a rear tag link bore (not shown) of one of the tag links 25 to pivotally connect the frame member 55 and one of the tag links 25 to the mounting section 30. A rear upper pin 73 may extend through each upper carriage bore 53 of carriage member 40 and a rear connecting bore 66 of one of the connecting members 65 to pivotally connect each of the connecting members 65 to one of the connecting towers 47. A rear lower pin 74 extends through each lower carriage bore 54 of carriage member 40 and a rear frame bore 56 of frame member 55 to pivotally connect the carriage member 40 to the frame member 55.

Hydraulic cylinder or actuator 24 may be pivotally connected to linkage assembly 22. An upper actuator pin 75 extends through upper actuator tower bore 46 of actuator tower 43 and actuator bracket bore 87 of actuator 24 to pivotally connect the actuator to the carriage member 40. A lower actuator pin 76 extends through lower actuator bracket bore 59 in frame bracket 58 of frame member 55 and actuator rod bore 88 of actuator 24 to pivotally connect the actuator 24 to the frame member 55. Actuator 24 is movable between a retracted position and an extended position.

Through such a configuration, the frame member 55 and the connecting members 65 may pivot relative to the mounting section 30 while the mounting section is secured to the machine 10. The carriage member 40 may pivot relative to both the frame member 55 and the pair of connecting members 65. Movement of the linkage may be achieved by extending and retracting actuator 24 so that forces may be applied between the actuator tower 43 of the carriage member 40 and the frame member 55. The linkage assembly 22 is movable between a ground engaging position at which the actuator 24 is at the retracted position and a raised position at which the actuator 24 is at the extended position.

Figure 7:
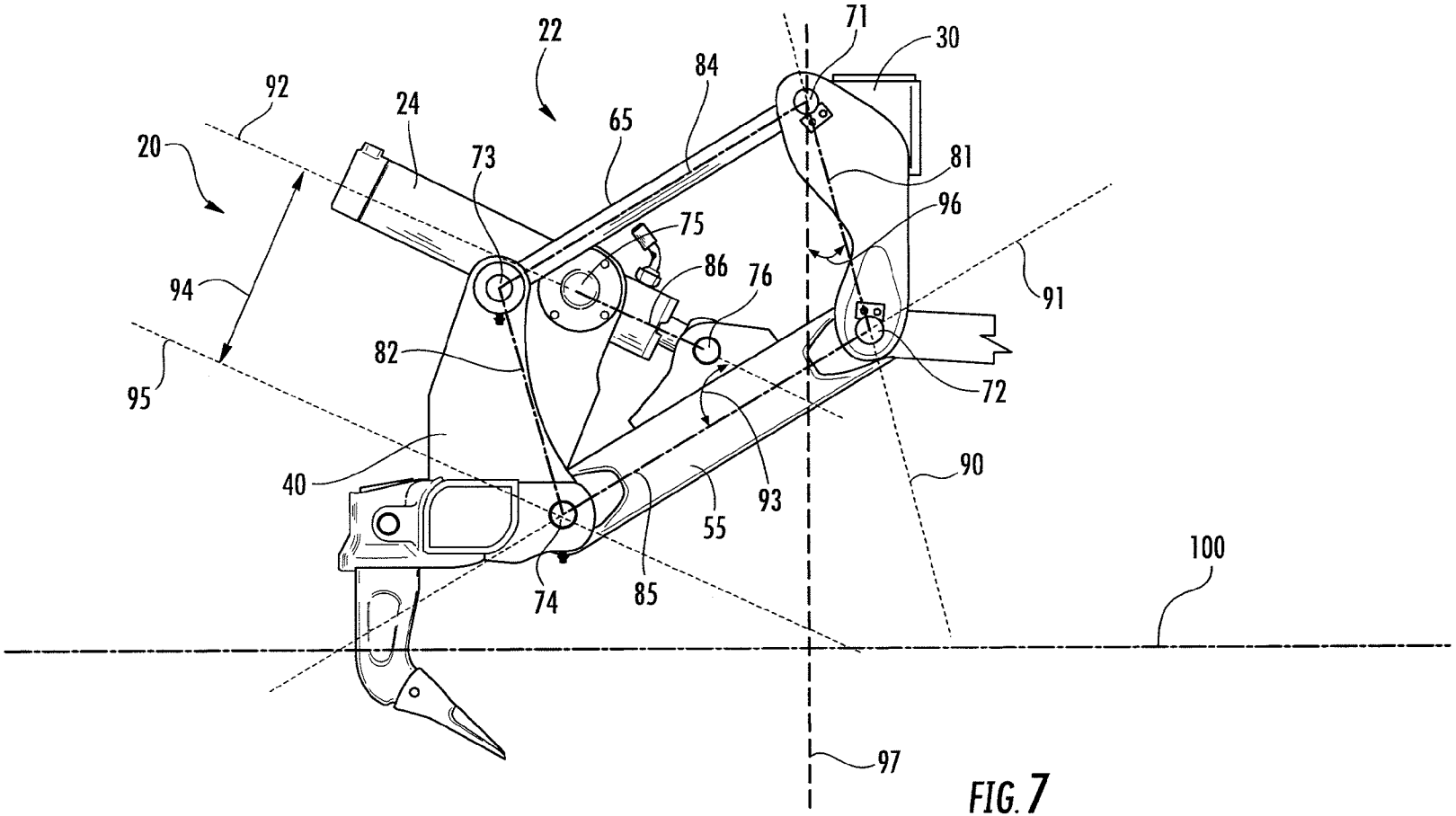
FIG. 7 is side view similar to FIG. 3 but depicting the links and angular relationships of the ripper assembly of FIG. 2.

As best seen in FIG. 7, linkage assembly 22 is generally shaped as a parallelogram. A line between the forward upper pin 71 and the forward lower pin 72 is depicted as a mounting link 81 having a mounting axis 90. A line between the rear upper pin 73 and the rear lower pin 74 is depicted as a carriage link 82. A line between the forward upper pin 71 and the rear upper pin 73 is depicted as a connecting link 84. A line between the forward lower pin 72 and the rear lower pin 74 is depicted as a frame link 85 having a frame axis 91. A line between the upper actuator pin 75 and the lower actuator pin 76 is depicted as an actuator segment 86 with an actuator axis 92. The upper actuator pin 75 and the lower actuator pin 76 are positioned within a circumferential boundary of the linkage assembly 22 when the linkage assembly is in the ground engaging position.

The relative angles of the components of ripper assembly 20 affect the performance, operational efficiency and configuration of the ripper assembly. The angle 93 of the actuator axis 92 relative to the frame axis 91 impacts the force required from the actuator 24 to generate the necessary downward force to maintain the ground engaging shank 23 of the ripper assembly 20 in the ground 100. The smaller the angle 93, the larger the actuator 24 that is required. Similarly, with a larger angle 93, a smaller actuator is required. However, the larger the angle 93 between the frame axis 91 and the actuator axis 92, the greater the force that is applied to and must be carried by the frame member 55. Increasing the forces carried by frame member 55 as well as the other components of the linkage assembly 22 may result in the need to make the linkage assembly 22 stronger and thus heavier. This increased weight results in reduced fuel economy of the machine 10, increases the need for counterbalance weights, and may reduce the operating characteristics of the machine.

It has been determined that one manner of optimizing the angles of the ripper assembly 20 is to maximize the distance 94 between the actuator axis 92 and a line 95 that is parallel to the actuator axis 92 and intersects with rear lower pin 74. In the depicted embodiment, the distance 94 is approximately eighty percent of the length of carriage link 82. It is believed, however, that in one embodiment, the distance 94 may be at least seventy five percent of the length of the carriage link 82 and, in another embodiment, it may be possible for the distance 94 to be at least sixty five percent of the length of carriage link 82.

As best seen in FIG. 7, the angle 93 between the frame axis 91 and the actuator axis 92 is approximately fifty five degrees±five degrees when the linkage assembly is in the ground engaging position. It is believed that the linkage assembly 22 will operate in a desired manner with the angle 93 ranging between approximately forty degrees and sixty five degrees when the linkage assembly is in the ground engaging position. Increasing the angle 93 above approximately sixty five degrees may increase the forces applied to the frame member 55 so as to require a more robust frame member. Reducing angle member 93 below approximately forty degrees may reduce the force applied to the frame member 55 but also reduce the force applied to the ground through the ground engaging shank 23 and thus require a larger actuator 24. In either case, increasing the size of the actuator 24 or the frame member 55 will likely result in a heavier ripper assembly.

Selection of the angles and positions of the components of the ripper assembly consistent with this disclosure can result in minimizing the sizes of the various ripper components. In addition, additional structure required to carry additional loads may be reduced or eliminated. For example, the actuator tower 43 has a pair of vertical central plates 44 with a single rear cover plate 45 connecting the two plates. In addition, the connecting towers 47 each have a pair of spaced apart vertical carriage plates 51 with a single rear carriage cover 52. The frame member 55 may be formed as a one piece member without significant reinforcing components to compensate for the increased load placed on the frame member by the actuator 24.

The mounting axis 90 forms an inclination angle 96 relative to a vertical line 97 that intersects the ground 100. In other words, the upper mounting bore 33 and forward upper pin 71 are closer to a rear end of the ripper assembly 20 than the lower mounting bore 34 and the forward lower pin 72. The forward upper pin 71 is angled closer to a rear end of the ripper assembly 20.

INDUSTRIAL APPLICABILITY

The industrial applicability of the system described herein will be readily appreciated from the foregoing discussion. The foregoing discussion is applicable to machines that utilize a ripper assembly 20. In one aspect, a ripper assembly 20 is disclosed including a linkage assembly 22 and an actuator 24. The linkage assembly 22 has a mounting section 30, a carriage member 40, a frame member 55, and a connecting member 65. The frame member 55 has a frame axis 91 and is pivotally connected to the mounting section 30. The carriage member 40 has at least one ground engaging shank 23 and is pivotally connected to the frame member 55. The connecting member 65 is pivotally connected to the mounting section 30 and is pivotally connected to the carriage member 40. The actuator 24 is movable along an actuator axis 92 between a retracted position and an extended position. The actuator 24 is pivotally connected to the frame member 55 and is pivotally connected to the carriage member 40. The linkage assembly 22 is movable between a ground engaging position at which the actuator 24 is at the retracted position and a raised position at which the actuator 24 is at the extended position. An angle 93 between the frame axis 91 and the actuator axis 92 is between approximately 40 degrees and 65 degrees when the linkage assembly 22 is in the ground engaging position.

In another aspect, a machine 10 is disclosed including a frame 12, a prime mover, a ground engaging propulsion device, and a ripper assembly 20. The ripper assembly 20 includes a linkage assembly 22 and an actuator 24. The linkage assembly has a mounting section, a frame member, a carriage member and a connecting member. The frame member 55 has a frame axis 91 and is pivotally connected to the mounting section 30. The carriage member 40 has at least one ground engaging shank 23 and is pivotally connected to the frame member 55. The connecting member 65 is pivotally connected to the mounting section 30 and is pivotally connected to the carriage member 40. The actuator 24 is movable along an actuator axis 92 between a retracted position and an extended position. The actuator 24 is pivotally connected to the frame member 55 and is pivotally connected to the carriage member 40. The linkage assembly 22 is movable between a ground engaging position at which the actuator 24 is at the retracted position and a raised position at which the actuator 24 is at the extended position. An angle 93 between the frame axis 91 and the actuator axis 92 is between approximately 40 degrees and 65 degrees when the linkage assembly 22 is in the ground engaging position.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A ripper assembly, comprising:

a linkage assembly having:

a mounting section configured to secure the ripper assembly to a machine, the mounting section having an upper mounting bore and a lower mounting bore;

a frame member having a frame axis and first and second spaced apart ends; the frame member being pivotally connected to the mounting section at the lower mounting bore;

a carriage member having at least one ground engaging shank and being pivotally connected to the frame member; and a rigid connecting member being pivotally connected to the mounting section at the upper mounting bore and pivotally connected to the carriage member; and an actuator being movable along an actuator axis between a retracted position and an extended position, the actuator being pivotally connected to the frame member generally between the first and second spaced apart ends and pivotally connected to the carriage member;

the linkage assembly being movable between a ground engaging position at which the actuator is at the retracted position and a raised position at which the actuator is at the extended position, an angle between the frame axis and the actuator axis being between approximately 40 degrees and 65 degrees when the linkage assembly is in the ground engaging position.

2. The ripper assembly of claim 1, wherein the actuator is pivotally connected directly to the carriage assembly through an upper actuator pin and is pivotally connected directly to the frame member through a lower actuator pin, the upper actuator pin being farther from a ground reference than the lower actuator pin.

3. The ripper assembly of claim 2, wherein the upper actuator pin and the lower actuator pin are positioned within a circumferential boundary of the linkage assembly when the linkage assembly is in the ground engaging position.

4. The ripper assembly of claim 1, wherein the angle between the frame axis and the actuator axis is approximately 55 degrees±5 degrees when the linkage assembly is in the ground engaging position.

5. The ripper assembly of claim 1, wherein the connecting member is pivotally connected to the mounting section through a forward upper pin, the frame member is pivotally connected to the mounting section through a forward lower pin, the forward upper pin and the forward lower pin being positioned along a mounting axis, the mounting axis being at an angle to a vertical line that intersects a ground reference, and the forward upper pin being angled towards a rear end of the ripper assembly.

6. The ripper assembly of claim 1, wherein the frame member is generally planar.

7. The ripper assembly of claim 1, wherein the carriage member is pivotally connected to the connecting member through a rear upper pin, the carriage member is pivotally connected to the frame member through a rear lower pin, the carriage member has a length between the rear upper pin and the rear lower pin, and a distance between the actuator axis and a line parallel to the actuator axis and intersecting with the rear lower pin is at least 65 percent of the length.

8. The ripper assembly of claim 7, wherein the distance is at least 75 percent of the length of the carriage member.

9. The ripper assembly of claim 1, wherein the carriage member has a cross member with an actuator tower generally centrally located on the cross member and extending from the cross member in a direction opposite the ground engaging shank, the actuator being pivotally connected to the carriage member at the actuator tower.

10. The ripper assembly of claim 9, further including a pair of spaced apart connecting members, each connecting member being pivotally connected to the mounting section through an forward upper pin, and wherein the carriage member further includes a pair of connecting towers extending from the cross member in a direction generally parallel to the actuator tower, the connecting towers being positioned on opposite sides of the actuator tower, each connecting member further being pivotally connected to one of the connecting towers through an a rear upper pin.

11. The ripper assembly of claim 10, wherein the carriage member is pivotally connected to the frame member through a pair of rear lower pins, each rear lower pin extending through one of the connecting towers.

12. A machine comprising:

a frame;

a prime mover;

a ground-engaging propulsion device; and a ripper assembly including:

a linkage assembly having:

a mounting section mounting the ripper assembly to the frame, the mounting section having an upper mounting bore and a lower mounting bore;

a frame member having, a frame axis and first and second spaced apart ends, the frame member being pivotally connected to the mounting section at the lower mounting bore;

a carriage member having at least one ground engaging shank and being pivotally connected to the frame member; and a rigid connecting member being pivotally connected to the mounting section at the upper mounting bore and pivotally connected to the carriage member; and an actuator being movable along an actuator axis between a retracted position and an extended position, the actuator being pivotally connected to the frame member generally between the first and second spaced apart ends and pivotally connected to the carriage member;

the linkage assembly being movable between a ground engaging position at which the actuator is at the retracted position and a raised position at which the actuator is at the extended position, an angle between the frame axis and the actuator axis being between approximately 40 degrees and 65 degrees when the linkage assembly is in the ground engaging position.

13. The machine of claim 12, wherein the linkage assembly is generally shaped as a parallelogram.

14. The machine of claim 12, wherein the actuator is pivotally connected directly to the carriage assembly through an upper actuator pin and is pivotally connected directly to the frame member through a lower actuator pin, the upper actuator pin being farther from a ground reference than the lower actuator pin.

15. The machine of claim 12, wherein the angle between the frame axis and the actuator axis is approximately 55 degrees±5 degrees when the linkage assembly is in the ground engaging position.

16. The machine of claim 12, wherein the carriage member is pivotally connected to the connecting member through an a rear upper pin, the carriage member is pivotally connected to the frame member through a rear lower pin, the carriage member has a length between the a rear upper pin and the rear lower pin, and a distance between the actuator axis and a line parallel to the actuator axis and intersecting with the rear lower pin is at least 65 percent of the length.

17. The machine of claim 16, wherein the distance is at least 75 percent of the length.

18. The machine of claim 12, wherein the carriage member has a cross member with an actuator tower extending from the cross member in a direction opposite the ground engaging shank, the actuator being pivotally connected to the carriage member at the actuator tower, and further including a pair of spaced apart connecting members, each connecting member being pivotally connected to the mounting section through a forward upper pin, and wherein the carriage member further includes a pair of connecting towers extending from the cross member in a direction generally parallel to the actuator tower, the connecting towers being positioned on opposite sides of the actuator tower, each connecting member further being pivotally connected to one of the connecting towers through an a rear upper pin.

19. A ripper assembly, comprising:

a linkage assembly having:

a mounting section configured to secure the ripper assembly to a machine;

a frame member having a frame axis; the frame member being pivotally connected to the mounting section at the lower mounting bore through a forward lower pin;

a connecting member being pivotally connected to the mounting section at the upper mounting bore through a forward upper pin; and a rigid carriage member having at least one ground engaging shank, the carriage member being a rigid link pivotally connecting the frame member and the connecting member; and an actuator being movable along an actuator axis between a retracted position and an extended position, the actuator being pivotally connected directly to the frame member through a lower actuator pin and pivotally connected directly to the carriage member through an upper actuator pin, the upper actuator pin being farther from a ground reference than the lower actuator pin, the upper actuator pin and the lower actuator pin being positioned within a circumferential boundary of the linkage assembly when the linkage assembly is in the ground engaging position, the circumferential boundary being defined by the forward upper pin, the forward lower pin, the lower actuator pin, and the upper actuator pin;

the linkage assembly being movable between a ground engaging position at which the actuator is at the retracted position and a raised position at which the actuator is at the extended position, an angle between the frame axis and the actuator axis being between approximately 40 degrees and 65 degrees when the linkage assembly is in the ground engaging position.

20. The ripper assembly of claim 19, wherein the linkage assembly is generally shaped as a parallelogram.

21. The ripper assembly of claim 19, further including a pair of spaced apart connecting members, and only a single actuator is positioned generally between the connecting members.

* * * * *